US009518586B2

(12) United States Patent
Yen et al.

(10) Patent No.: US 9,518,586 B2
(45) Date of Patent: Dec. 13, 2016

(54) INLINE AXIAL FLOW FAN

(71) Applicant: SANYO DENKI CO., LTD., Tokyo (JP)

(72) Inventors: Jun Chieh Yen, Toshima-ku (JP); Honami Oosawa, Toshima-ku (JP)

(73) Assignee: SANYO DENKI CO., LTD., Tokyo (JP)

( * ) Notice: Subject to any disclaimer, the term of this patent is extended or adjusted under 35 U.S.C. 154(b) by 573 days.

(21) Appl. No.: 13/967,529

(22) Filed: Aug. 15, 2013

(65) Prior Publication Data

US 2014/0056688 A1 Feb. 27, 2014

(30) Foreign Application Priority Data

Aug. 24, 2012 (JP) ..... 2012-185235

(51) Int. Cl.

| | |
|---|---|
| ***F04D 19/02*** | (2006.01) |
| ***F04D 19/00*** | (2006.01) |
| ***F04D 25/16*** | (2006.01) |
| ***F04D 29/54*** | (2006.01) |

(52) U.S. Cl.

CPC ..... *F04D 19/007* (2013.01); *F04D 25/166* (2013.01); *F04D 29/544* (2013.01)

(58) Field of Classification Search

CPC ..... F04D 19/007; F04D 25/166; F04D 29/544

USPC ..... 415/68, 208.1, 199.5, 209.1, 208.2,415/211.2, 224

See application file for complete search history.

(56) References Cited

U.S. PATENT DOCUMENTS

| | | | | |
|---|---|---|---|---|
| 6,511,300 | B2 | 1/2003 | Otsuka | |
| 6,663,342 | B2 | 12/2003 | Huang et al. | |
| 7,014,420 | B2 | 3/2006 | Chang | |
| 8,197,198 | B2 | 6/2012 | Miyabara et al. | |
| 8,210,795 | B2 * | 7/2012 | Lin | F04D 19/007 415/68 |
| 2004/0083609 | A1 | 5/2004 | Malott | |

(Continued)

FOREIGN PATENT DOCUMENTS

| | | |
|---|---|---|
| JP | 2002-070794 A | 3/2002 |
| JP | 2003-056498 A | 2/2003 |

(Continued)

OTHER PUBLICATIONS

Official Notice of Reason for Refusal for Japanese Patent Appln. No. 2012-185235 dated Nov. 12, 2013.

*Primary Examiner* — Nicholas J Weiss
*Assistant Examiner* — Ngoc T Nguyen
(74) *Attorney, Agent, or Firm* — Polsinelli PC

(57) ABSTRACT

There is disclosed an inline axial flow fan including at least first and second axial flow fans and arranged in an inline manner along an axial direction of a rotational shaft of a rotational driving apparatus. A first flow control grid is arranged in a gas discharge side of the first axial flow fan, and a second flow control grid is arranged in a gas discharge side of the second axial flow fan. The first flow control grid has a stator blade having a smooth circular arc leading edge shape matching a circular arc shape of the stator blade of the first axial flow fan and a trailing edge shape extending in parallel with a gas flow direction. The second flow control grid has a stator blade having a smooth circular arc shape matching a circular arc shape of the stator blade of the second axial flow fan.

7 Claims, 6 Drawing Sheets

(56) References Cited

U.S. PATENT DOCUMENTS

| | | | | |
|---|---|---|---|---|
| 2009/0060732 | A1* | 3/2009 | Hsu | F04D 19/007 415/208.1 |
| 2009/0226299 | A1* | 9/2009 | Jin | F04D 19/007 415/68 |
| 2009/0290984 | A1* | 11/2009 | Miyabara | F04D 19/007 416/198 R |
| 2012/0020780 | A1 | 1/2012 | Uchiyama et al. | |

FOREIGN PATENT DOCUMENTS

| | | | |
|---|---|---|---|
| JP | 2004-156591 | A | 6/2004 |
| JP | 2010-007657 | A | 1/2010 |
| JP | 2012-026291 | A | 2/2012 |

* cited by examiner

INLINE AXIAL FLOW FAN

CROSS-REFERENCE TO RELATED APPLICATION

This application claims priority to Japanese Application No. 2012-185235, filed Aug. 24, 2012, the entirety of which is incorporated herein by reference.

BACKGROUND

1. Technical Field

The present invention relates to an inline axial flow fan having a plurality of axial flow fans arranged in an inline manner along a rotational shaft direction of a rotational driving apparatus.

2. Description of Related Arts

An axial flow fan includes an impeller having a plurality of rotor blades installed in a rotational shaft of a rotational driving apparatus, a cylindrical casing that forms an axial flow along with the impeller, and a plurality of stator blades installed in an inner circumferential portion of the casing.

Typically, an air-blowing property of the axial flow fan is characterized in a large air volume and a small static pressure. In order to improve the air-blowing property of the axial flow fan, various inline axial flow fans have been proposed, in which a plurality of axial flow fans is arranged in an inline manner along a rotational shaft direction of a rotational driving apparatus.

As a technique regarding the inline axial flow fan, there has been proposed an axial flow fan having a first axial flow fan, a first flow control grid, a second axial flow fan, and a second flow control grid sequentially arranged in an inline manner from an upstream side along an airflow direction (for example, refer to Japanese Patent Application Laid-Open Publication No. 2012-026291). In the axial flow fan disclosed in Japanese Patent Application Laid-Open Publication No. 2012-026291, the first flow control grid has a stator blade having an elbow shape bent with respect to a rotational direction of the first axial flow fan, and the second flow control grid has a stator blade having a trailing edge shape extending in parallel with the airflow direction.

However, the axial flow fan discussed in Japanese Patent Application Laid-Open Publication No. 2012-026291, the first flow control grid has a stator blade having an elbow shape bent with respect to the rotational direction of the first axial flow fan. In addition, the second flow control grid has a stator blade having a trailing edge shape extending in parallel with the airflow direction.

Therefore, discontinuity of the stator blade shape is generated in a border between the stator blade of the first axial flow fan and the stator blade of the first flow control grid and a border between the stator blade of the second axial flow fan and the stator blade of the second flow control grid. If the stator blade shape is discontinuous, a turbulent flow may be generated in the discontinuous portion, and this may adversely influence reduction of a power consumption and a load noise.

SUMMARY

In view of the aforementioned problems, the present invention provides an inline axial flow fan capable of reducing a power consumption and a load noise, compared to the inline axial flow fan of the related art.

An inline axial flow fan for achieving the above object has at least first and second axial flow fans arranged in an inline manner along an axial direction of a rotational shaft of a rotational driving apparatus.

A first flow control grid is arranged in a gas discharge side of the first axial flow fan, and a second flow control grid is arranged in a gas discharge side of the second axial flow fan.

The first flow control grid has a stator blade having a smooth circular arc leading edge shape matching a circular arc shape of the stator blade of the first axial flow fan and a trailing edge shape extending in parallel with an airflow direction.

The second flow control grid has a stator blade having a smooth circular arc shape matching a circular arc shape of a stator blade of the second axial flow fan.

In the inline axial flow fan according to the present invention, the first flow control grid has the stator blade having a smooth circular arc leading edge shape matching the circular arc shape of the stator blade of the first axial flow fan and a trailing edge shape extending in parallel with the airflow direction. Therefore, the airflow formed by the rotor blade of the first axial flow fan is fluently guided to the stator blade of the first flow control grid.

In addition, the second flow control grid has the stator blade having a smooth circular arc shape matching the circular arc shape of the stator blade of the second axial flow fan. Therefore, the airflow passing through the stator blade of the first flow control grid and accelerated by the rotor blade 32 of the second axial flow fan is fluently guided to the stator blade of the second flow control grid.

For this reason, using the inline axial flow fan according to the present embodiment, it is possible to reduce a power consumption and a load noise, compared to an inline axial flow fan of the related art.

DETAILED DESCRIPTION

Hereinafter, an inline axial flow fan according to the present embodiment will be described with reference to the accompanying drawings.

An axial flow fan is an air-blowing apparatus that intakes an air flow from one side of an axial direction of a rotational shaft and discharges the air flow to the other side of the axial direction by virtue of rotation of an impeller installed in a rotational shaft of a rotational driving apparatus. In the inline axial flow fan according to the present embodiment, a power consumption and a load noise can be reduced, compared to an inline axial flow fan of the related art by improving stator blade shapes of first and second flow control grids.

<Configuration of Inline Axial Flow Fan>

Figure 1:
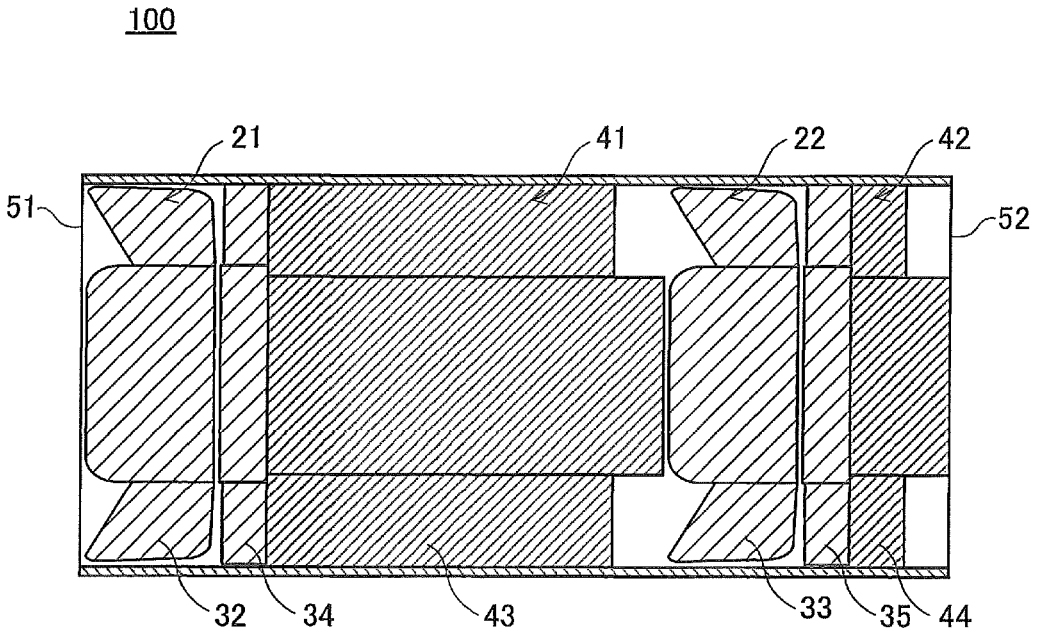
FIG. 1 is a cross-sectional view illustrating an inline axial flow fan according to the present embodiment.
Figure 2:
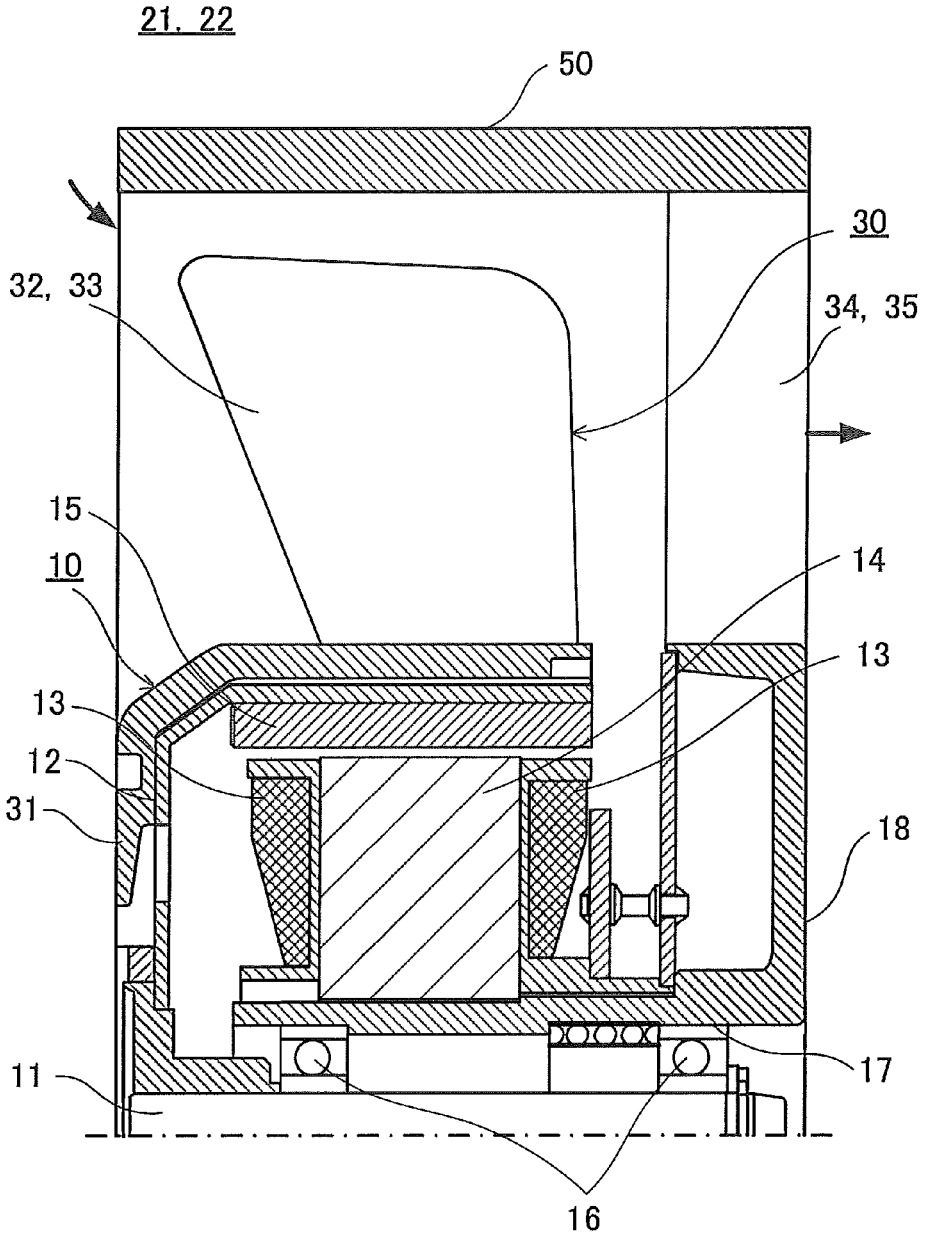
FIG. 2 is a cross-sectional view illustrating an internal structure of an axial flow fan included in the inline axial flow fan according to the present embodiment.

First, a configuration of the inline axial flow fan according to the present embodiment will be described with reference to FIGS. 1 and 2. FIG. 1 is a cross-sectional view illustrating an inline axial flow fan according to the present embodiment. FIG. 2 is a cross-sectional view illustrating an internal structure of the axial flow fan included in the inline axial flow fan according to the present embodiment.

As illustrated in FIG. 1, the inline axial flow fan 100 according to the present embodiment includes at least first and second axial flow fans 21 and 22 arranged in an inline manner along an axial direction of the rotational shaft 11 of the rotational driving apparatus 10. In addition, a first flow control grid 41 is arranged in a discharge side of gases (hereinafter, simply referred to as the "air") of the first axial flow fan 21, and a second flow control grid 42 is arranged in a discharge side of the air of the second axial flow fan 32.

That is, the inline axial flow fan 100 according to the present embodiment includes the first axial flow fan 21, the first flow control grid 41, the second axial flow fan 22, and the second flow control grid 42 sequentially arranged in a cylindrical venturi casing (hereinafter, simply referred to as a "casing") 50 along an airflow direction.

In the casing 50, an air channel that guides the airflow is dividingly formed. In addition, an air intake duct 51 and an air discharge duct 52 are formed at opposite ends of casing 50.

The first and second axial flow fans 21 and 22 are designed to have the same structure and the same rotational direction.

Each axial flow fan 21 and 22 includes an impeller 30 having a plurality of rotor blades 32 and 33 installed in the rotational shaft 11 of the rotational driving apparatus 10, a casing 50 that surrounds an outer circumference of the impeller 30 in a radial direction, and a plurality of stator blades 34 and 35 installed in an inner circumferential portion of the casing 50.

The impeller 30 has a cup-like hub portion 31 in the center, and a plurality of rotor blades 32 and 33 is integrally installed around the hub portion 31 in a radial shape. The rotor blades 32 and 33 of the axial flow fan 21 and 22, respectively, are inclined with respect to the axial direction of the rotational shaft 11. The cross-sectional shapes of the rotor blades 32 and 33 of the axial flow fans 21 and 22, respectively, will be described below.

As illustrated in FIG. 2, a motor as the rotational driving apparatus 10 of the impeller 30 is provided inside the hub portion 31. The motor 10 includes a cup-like rotor yoke 12, a rotational shaft 11 pressedly inserted into the center of the rotor yoke 12, a stator core 14 where the coil 13 is wound, and the like.

The rotor yoke 12 is assembled into the inside of the hub portion 31. A magnet 15 is fixed to an inner circumferential surface of the rotor yoke 12.

The rotational shaft 11 is rotatably supported by a bearing 16. The bearing 16 is fixed to an inner surface of a cylindrical support portion 17. The support portion 17 is integrally fixed to a center of a cup-like base portion 18.

The stator core 14 is pressedly fixed to an outer surface of the support portion 17. The magnet 15 of the rotor yoke 12 and the stator core 14 face each other with a distant gap.

A plurality of stator blades 34 and 35 of the axial flow fans 21 and 22, respectively, is radially provided between the cup-like base portion 18 and the cylindrical casing 50. The cross-sectional shapes of the stator blades 34 and 35 of the axial flow fans 21 and 22, respectively, will be described below.

The first flow control grid 41 is interposed between the first and second axial flow fans 21 and 22. The first flow control grid 41 extends horizontally toward the airflow direction F and has a plurality of stator blades 43 having the cross-sectional shape described below. Using the stator blade 43 of the first flow control grid 41, a vortex component of the airflow generated by the first axial flow fan 21 is removed, so that noise generation is suppressed.

The second flow control grid 42 is arranged in an air discharge side of the second axial flow fan 22. The second flow control grid 42 is formed to be shorter than the first flow control grid 41 and has a plurality of stator blades 44 having a cross-sectional shape described below. Using the stator blade 44 of the second flow control grid 42, a vortex component of the airflow generated by the second axial flow fan 22 is removed, so that noise generation is suppressed.

Figure 3:
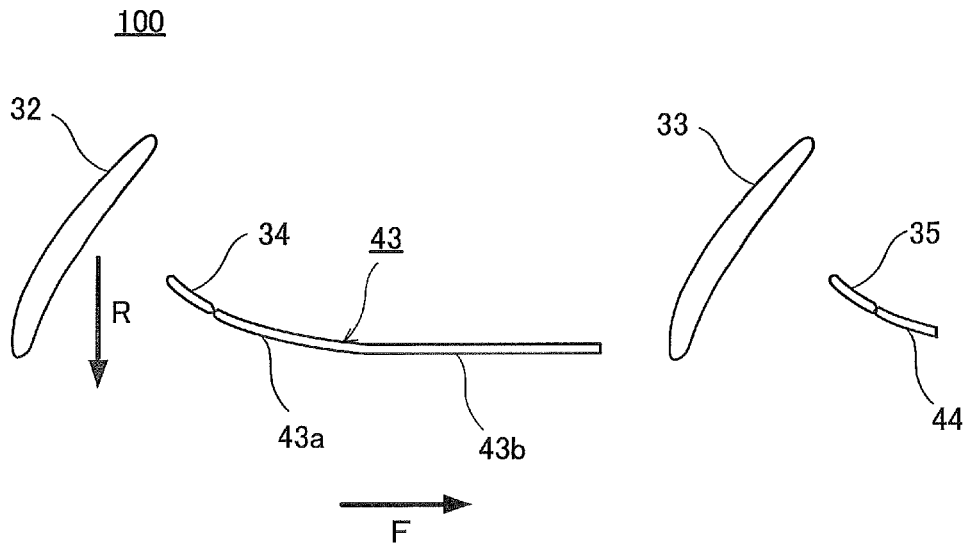
FIG. 3 is a schematic cross-sectional view illustrating an airfoil shape of the inline axial flow fan according to the present embodiment.

Next, an airfoil shape of the inline axial flow fan according to the present embodiment will be described with reference to FIG. 3. The inline axial flow fan 100 according to the present embodiment is characterized in the stator blade shapes of the first and second flow control grids 41 and 42. FIG. 3 is a schematic cross-sectional view illustrating the stator blade shape of the inline axial flow fan according to the present embodiment.

As illustrated in FIG. 3, the cross section of the rotor blade 32 of the first axial flow fan 21 has, for example, an airfoil shape. However, the shape of the rotor blade 32 is not limited thereto. The rotor blade 32 of the first axial flow fan 21 is formed to have a concave shape toward a movement direction R of the rotor blade 32 and a convex shape toward a direction opposite to the airflow direction F.

The stator blade 34 of the first axial flow fan 21 is located in a downstream side of the airflow direction F of the rotor blade 32 of the first axial flow fan 21. The cross section of the stator blade 34 of the first axial flow fan 21 has a circular arc shape. The stator blade 34 of the first axial flow fan 21 is formed to have a convex shape in the radial direction.

A stator blade 43 of the first flow control grid 41 is located in a slip stream side of the airflow direction F of the stator blade 34 of the first axial flow fan 21. The stator blade 43 of the first flow control grid 41 has a smooth circular arc leading edge shape 43*a* matching the circular arc shape of the stator blade 34 of the first axial flow fan 21 and a trailing edge shape 43*b* extending in parallel with the airflow direction F. That is, the leading edge shapes 43*a* of the stator blade 43 of the first flow control grid 41 and the stator blade 34 of the first axial flow fan 21 are formed such that a curve of the circular arc shape is continuously connected. The trailing edge shape 43*b* of the stator blade 43 is continuously connected to the leading edge shape 43*a* of the stator blade 43 of the first flow control grid 41.

A rotor blade 33 of the second axial flow fan 22 is located in the slip stream side of the airflow direction F of the stator blade 43 of the first flow control grid 41. Although the rotor blade 33 of the second axial flow fan 22 has, for example, an airfoil shape, similar to the rotor blade 32 of the first axial flow fan 21, the shape of the rotor blade 33 is not limited thereto. The rotor blade 33 of the second axial flow fan 22 is formed to have a concave shape toward a movement direction R of the rotor blade 33 and a convex shape toward a direction opposite to the airflow direction F.

A stator blade 35 of the second axial flow fan 22 is located in the slip stream side of the airflow direction F of the rotor blade 33 of the second axial flow fan 22. The cross section of the stator blade 35 of the second axial flow fan 22 has a circular arc shape. The stator blade 35 of the second axial flow fan 22 is formed to have a convex shape toward the outside of the radial direction.

A stator blade 44 of the second flow control grid 42 is located in the slip stream side of the airflow direction F of the stator blade 35 of the second axial flow fan 22. The stator blade 44 of the second flow control grid 42 has a smooth circular arc shape matching the circular arc shape of the stator blade 35 of the second axial flow fan 22. That is, the stator blade 35 of the second axial flow fan 22 and the stator blade 44 of the second flow control grid 42 are formed such that a curve of the circular arc shape is continuously connected.

<Effects of Inline Axial Flow Fan>

Next, effects of the inline axial flow fan 100 according to the present invention will be described with reference to FIGS. 1 to 6.

As illustrated in FIGS. 1 and 2, the inline axial flow fan 100 according to the present embodiment is installed in a housing such as an electronic device housing by fastening an installation screw to an intake-side flange portion or a discharge-side flange portion (not illustrated) provided in the casing 50.

For example, in a case where the inline axial flow fan 100 is used as a server cooling fan, the intake-side flange portion is installed in a fan holding portion on an inner surface of the server housing.

The first and second axial flow fans 21 and 22 are rotated in the same rotational direction and are not rotated in a different direction. As the impellers 30 of the first and second axial flow fans 21 and 22 are rotated, the air is inhaled from the intake duct 51 of the first axial flow fan 21.

As illustrated in FIGS. 1 and 3, the air inhaled from the intake duct 51 of the first axial flow fan 21 sequentially passes through the rotor blade 32 of the first axial flow fan 21, the stator blade 34 of the first axial flow fan 21, the stator blade 43 of the first flow control grid 41, the rotor blade 33 of the second axial flow fan 22, the stator blade 35 of the second axial flow fan 22, and the stator blade 44 of the second flow control grid 42 and is discharged from a discharge duct of the second flow control grid 42.

The leading edge shapes 43*a* of the stator blade 34 of the first axial flow fan 21 and the stator blade 43 of the first flow control grid 41 are formed such that a curve of the circular arc shape is continuously connected. The trailing edge shape 43*b* of the stator blade 43 is continuously connected to the leading edge shape 43*a* of the stator blade 43 of the first flow control grid 41. Therefore, the airflow formed by the rotor blade 32 of the first axial flow fan 21 is smoothly guided to the stator blade 43 of the first flow control grid 41.

The stator blade 35 of the second axial flow fan 22 and the stator blade 44 of the second flow control grid 42 are formed such that a curve of the circular arc shape is continuously connected. Therefore, the airflow passing through the stator blade 43 of the first flow control grid 41 and accelerated by the rotor blade 32 of the second axial flow fan 22 is smoothly guided to the stator blade 44 of the second flow control grid 42 and is discharged from the discharge duct 52 of the casing 50.

Figure 4:
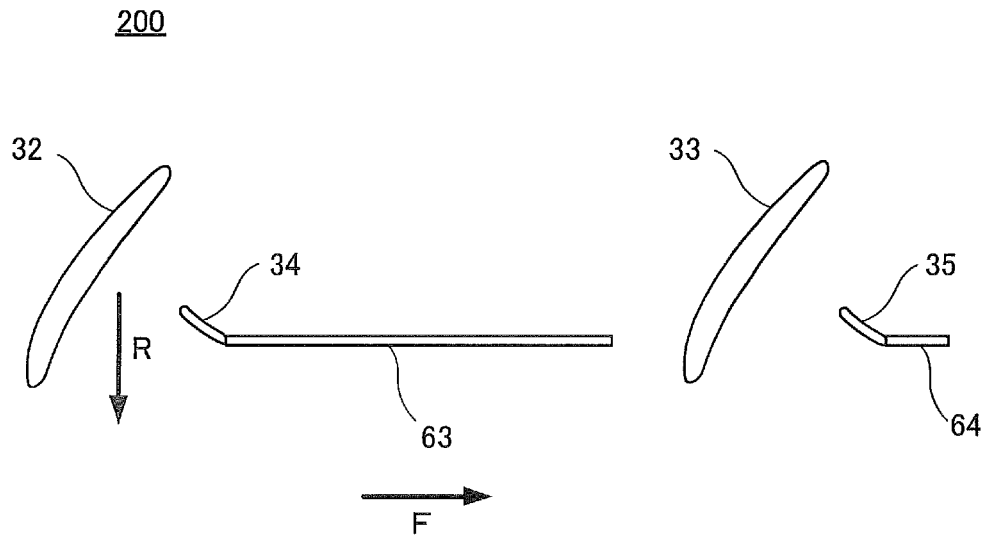
FIG. 4 is a schematic cross-sectional view illustrating a stator blade shape of the inline axial flow fan of the related art.

Next, effects of the inline axial flow fan 100 according to the present invention will be described with reference to FIGS. 4 to 6 by comparing with the effects of the inline axial flow fan 200 of the related art. FIG. 4 is a schematic cross-sectional view illustrating a stator blade shape of the inline axial flow fan of the related art. In FIG. 4, like reference numerals denote like elements as in the inline axial flow fan 100 according to the present embodiment, and description thereof will not be repeated.

As illustrated in FIG. 4, the inline axial flow fan 200 of the related art includes the first axial flow fan, the first flow control grid, the second axial flow fan, and the second flow control grid in the same order as that of the inline axial flow fan 100 according to the present embodiment. In addition, the inline axial flow fan 200 of the related art has the first and second axial flow fans having the same configurations as those of the inline axial flow fan 100 according to the present embodiment.

That is, the rotor blade 32 and the stator blade 34 of the first axial flow fan and the rotor blade 33 and the stator blade 35 of the second axial flow fan have the same cross-sectional shape.

The inline axial flow fan 200 of the related art is different from the inline axial flow fan 100 according to the present embodiment in cross-sectional shapes of the stator blade 63 of the first flow control grid and the stator blade 64 of the second flow control grid.

The stator blade 63 of the first flow control grid extends horizontally in parallel with the airflow direction F. The stator blade 63 of the first flow control grid is bent in an elbow shape along with the stator blade 34 of the first axial flow fan.

The stator blade 64 of the second flow control grid is shorter than the stator blade 63 of the first flow control grid and extends in parallel with the airflow direction F. The stator blade 64 of the second flow control grid is bent in an elbow shape along with the stator blade 35 of the second axial flow fan.

Figure 5:
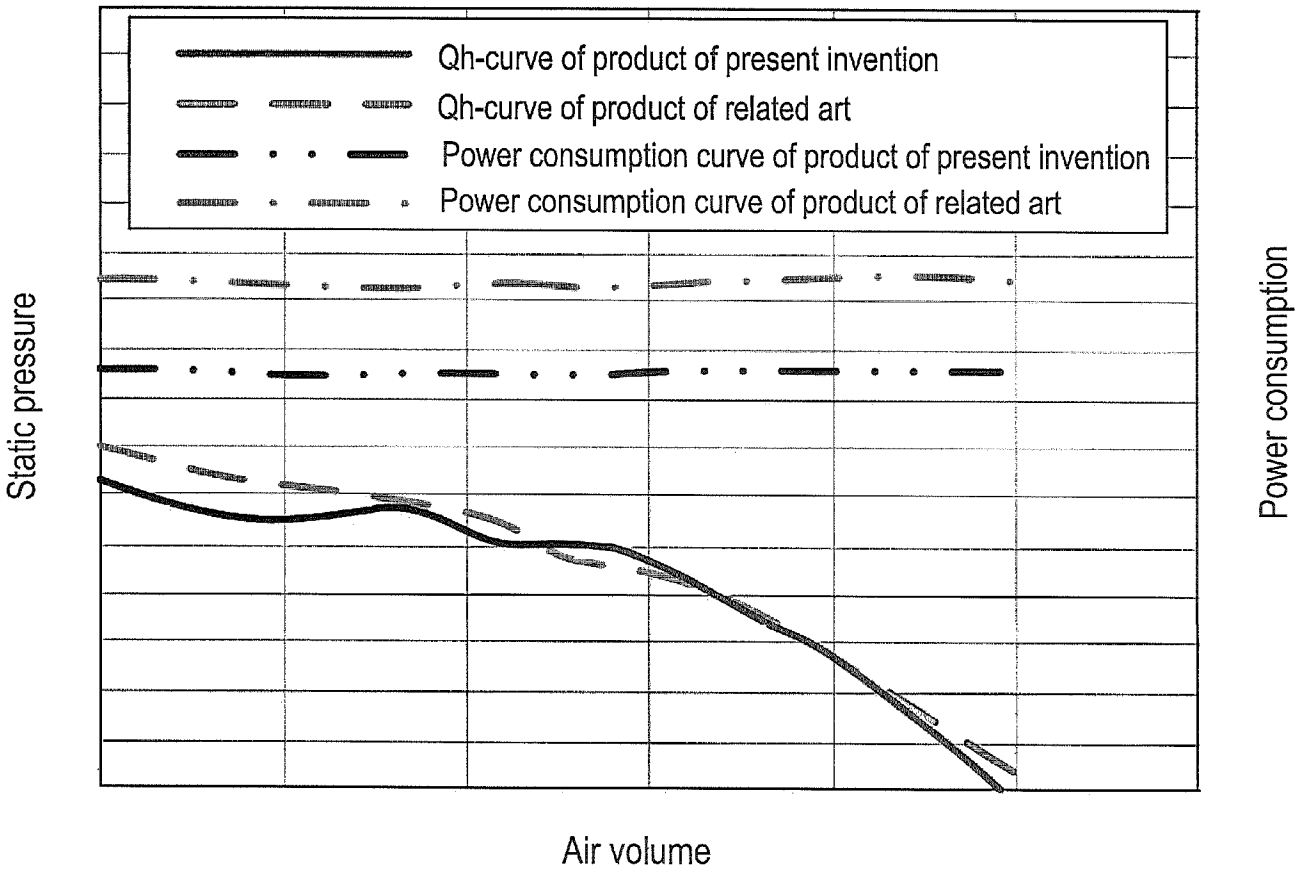
FIG. 5 is an explanatory diagram for comparing a power consumption characteristic between a product of the present invention and a product of the related art.

FIG. 5 is an explanatory diagram for comparing a power consumption characteristic between a product of the present invention and a product of the related art.

Focusing on the Qh-curve of FIG. 5, a static pressure of the product of the related art is higher than that of the product of the present invention when the air volume is small. However, as the air volume increases, the static pressure of the product of the related art becomes approximately equal to the static pressure of the product of the present invention.

Meanwhile, focusing on the power consumption curve of FIG. 5, it is recognized that the power consumption of the product of the present invention can be reduced compared to the power consumption of the product of the related art regardless of the air volume in a relationship between the air volume and the static pressure.

Figure 6:
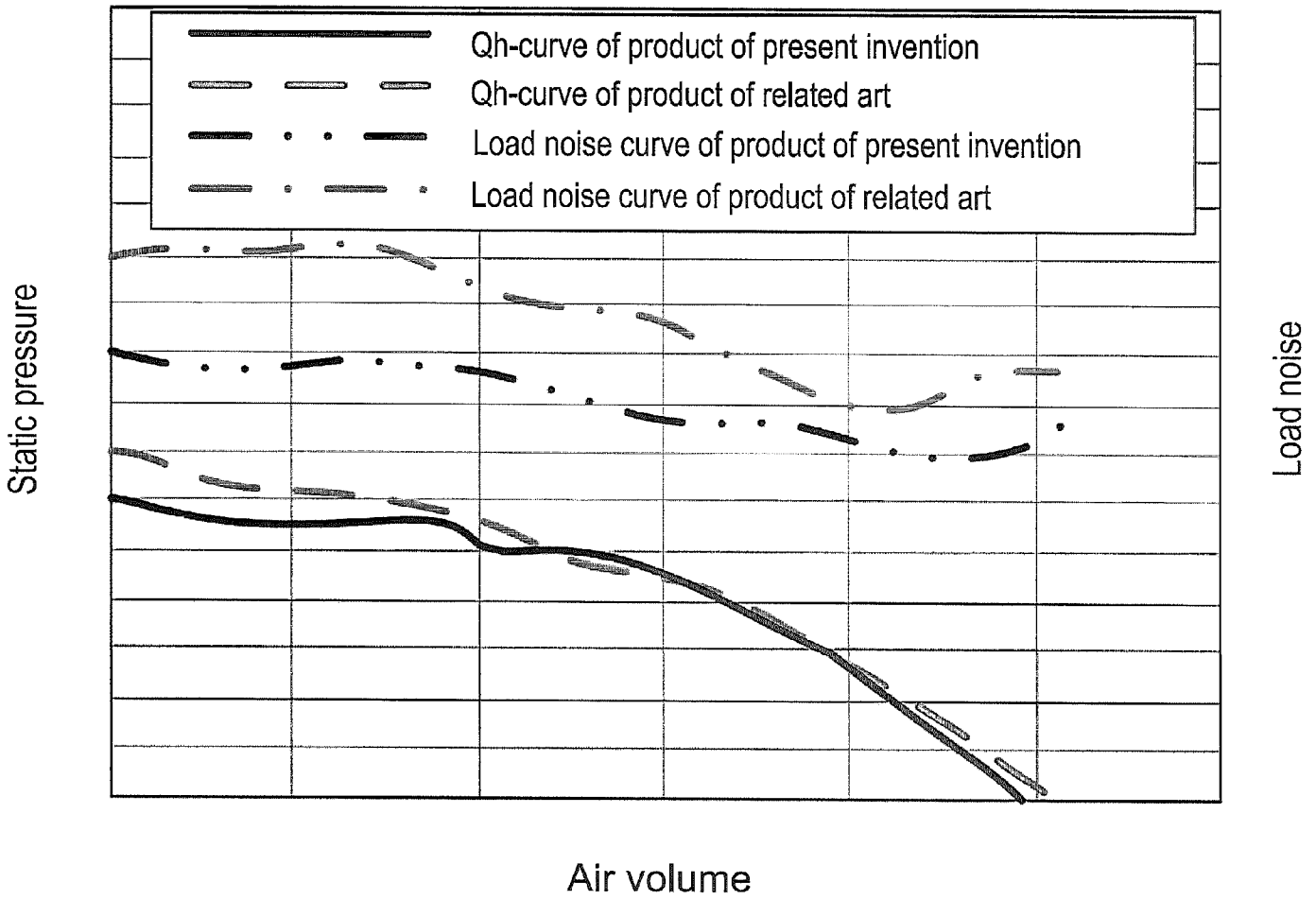
FIG. 6 is an explanatory diagram for comparing a load noise characteristic between a product of the present invention and a product of the related art.

FIG. 6 is an explanatory diagram for comparing a load noise characteristic between the product of the present invention and the product of the related art.

Focusing on the Qh-curve of FIG. 6, similar to FIG. 5, the static pressure of the product of the related art is higher than the static pressure of the product of the present invention when the air volume is small. However, as the air volume increases, the static pressure of the product of the related art becomes approximately equal to the static pressure of the product of the present invention.

Meanwhile, focusing on the load noise curve of FIG. 6, it is recognized that the load noise of the product of the present invention can be reduced, compared to the load noise of the product of the related art, regardless of the air volume in a relationship between the air volume and the static pressure.

In the inline axial flow fan 200 of the related art, the stator blade 63 of the first flow control grid is bent along with the stator blade 35 of the second axial flow fan, and the stator blade of the second flow control grid is bent along with the stator blade 34 of the first axial flow fan. Therefore, it is conceived that discontinuity of a stator blade shape may be generated in a border between the stator blade 34 of the first axial flow fan and the stator blade 63 of the first flow control grid 41 and a border between the stator blade 35 of the second axial flow fan and the stator blade 64 of the second flow control grid 42, so as to generate a turbulent flow.

On the contrary, in the inline axial flow fan 100 according to the present embodiment, the first flow control grid 41 has the stator blade 43 having the smooth circular arc leading edge shape 43*a* matching the circular arc shape of the stator blade 32 of the first axial flow fan 21 and the trailing edge shape 43*b* extending in parallel with the airflow direction F. Therefore, the airflow formed by the rotor blade 32 of the first axial flow fan 21 is fluently guided to the stator blade 43 of the first flow control grid 41.

In addition, the second flow control grid 42 has the stator blade 44 having a smooth circular arc shape matching the circular arc shape of the stator blade 33 of the second axial flow fan 22. Therefore, the airflow passing through the stator blade 43 of the first flow control grid 41 and accelerated by the rotor blade 32 of the second axial flow fan 22 is fluently guided to the stator blade 44 of the second flow control grid 42 and is discharged from the discharge duct 52 of the casing 50.

For the reasons described above, it is conceived that the power consumption and the load noise can be reduced using the inline axial flow fan 100 according to the present embodiment, compared to the inline axial flow fan 200 of the related art.

While preferable embodiments of the present invention have been described hereinbefore, they are only for descriptive purposes and are not intended to limit the scope of the invention thereto. The invention may be embodied in various aspects other than the aforementioned embodiment without departing from the spirit and scope of the invention.

[FIG. 5]

Qh-curve of product of present invention
Qh-curve of product of related art
Power consumption curve of product of present invention
Power consumption curve of product of related art
Static pressure
Air volume
Power consumption

[FIG. 6]

Qh-curve of product of present invention
Qh-curve of product of related art
Load noise curve of product of present invention
Load noise curve of product of related art
Static pressure
Air volume
Load noise

What is claimed is:

1. An inline axial flow fan having at least first and second axial flow fans arranged in an inline manner along an axial direction of a rotational shaft of a rotational driving apparatus, comprising:

a first rotor blade and a first stator blade that are included in the first axial flow fan;

a second rotor blade and a second stator blade that are included in the second axial flow fan;

a first flow control grid arranged in a gas discharge side of the first axial flow fan; and a second flow control grid arranged in a gas discharge side of the second axial flow fan, an axial length of the second flow control grid being shorter than an axial length of the first flow control grid, wherein:

the first flow control grid has a stator blade having a smooth circular arc leading edge shape matching a circular arc shape of the first stator blade of the first axial flow fan, and a trailing edge shape extending in parallel with an airflow direction, and the second flow control grid has a stator blade having a smooth circular arc shape matching a circular arc shape of the second stator blade of the second axial flow fan.

2. The inline axial flow fan according to claim 1, wherein the leading edge shapes of the first stator blade of the first axial flow fan and the stator blade of the first flow control grid are formed such that curves of the circular arc shapes are continuously connected, and the trailing edge shape of the stator blade is continuously connected to the leading edge shape of the stator blade of the first flow control grid.

3. The inline axial flow fan according to claim 1, wherein the leading edge shapes of the second stator blade of the second axial flow fan and the stator blade of the second flow control grid are formed such that curves of the circular arc shapes are continuously connected, and the trailing edge shape of the stator blade is continuously connected to the leading edge shape of the stator blade of the second flow control grid.

4. The inline axial flow fan according to claim 1, wherein, the first rotor blade of the first axial flow fan is formed to have a concave shape toward a rotation direction of the first rotor blade and a convex shape toward a direction opposite to an airflow direction, the first stator blade of the first axial flow fan is located in a slip downstream side of the airflow direction of the first rotor blade, and the first stator blade is formed to have a convex shape from the rotational shaft toward an outer side in a radial direction.

5. The inline axial flow fan according to claim 1, wherein, the second rotor blade of the second axial flow fan is formed to have a concave shape toward a rotation direction of the second rotor blade and a convex shape toward a direction opposite to an airflow direction, the second stator blade of the second axial flow fan is located in a downstream side of the airflow direction of the second rotor blade, and the second stator blade is formed to have a convex shape from the rotational shaft toward an outer side in a radial direction.

6. The inline axial flow fan according to claim 1, wherein a trailing portion of the second stator blade of the second flow control grid is not parallel to the airflow direction.

7. The inline axial flow fan of claim 1, further comprising an equal number of the axial flow fans and of the flow control grids.

* * * * *